US005996739A

United States Patent [19]

Hoffmann

[11] Patent Number: 5,996,739

[45] Date of Patent: Dec. 7, 1999

[54] OIL LUBRICATION RATE MONITOR AND CONTROLLER

[75] Inventor: Amos Hoffmann, Ramat Gan, Israel

[73] Assignee: Hoffman & Hoffman, Ltd., Bnei-Brak, Israel

[21] Appl. No.: 08/963,145

[22] Filed: Nov. 3, 1997

[30] Foreign Application Priority Data

Nov. 11, 1996 [IL] Israel ..... 119601

[51] Int. Cl.[6] ..... F16N 27/00

[52] U.S. Cl. ..... 184/7.4; 184/6.4; 184/67; 137/486

[58] Field of Search ..... 184/6.1, 6.4, 6.22, 184/6.24, 7.4, 67, 108; 137/486, 487.5

[56] References Cited

U.S. PATENT DOCUMENTS

| | | | |
|---|---|---|---|
| 3,790,042 | 2/1974 | McCormick et al. | 222/52 |
| 4,038,982 | 8/1977 | Burke et al. | 128/214 |
| 4,261,388 | 4/1981 | Shelton | 137/486 |
| 4,372,304 | 2/1983 | Avakain et al. | 137/486 |
| 4,428,442 | 1/1984 | Steinke | 175/228 |
| 4,690,249 | 9/1987 | Olson, Jr. | 184/67 |
| 5,441,070 | 8/1995 | Thompson | 137/486 |
| 5,597,051 | 1/1997 | Moriya et al. | 184/6.4 |
| 5,598,973 | 2/1997 | Weston | 239/75 |
| 5,620,060 | 4/1997 | Bialke | 184/6.22 |

FOREIGN PATENT DOCUMENTS

| | | | |
|---|---|---|---|
| 232328 | 7/1963 | Austria | 184/67 |

*Primary Examiner*—Thomas R. Hannon
*Assistant Examiner*—Chong H. Kim
*Attorney, Agent, or Firm*—Thomas, Kayden, Horstemeyer, & Risley, LLP

[57] ABSTRACT

A passive gravitational drip lubrication system which includes lubrication rate monitoring and control to provide a constant lubrication rate in which the lubricant flow from the reservoir is adjusted by an electromagnetic valve apparatus, a drop detection apparatus senses the amount of lubricant dispensed, and a servo control apparatus adjusts the preselected flow rate by adjusting the electromagnetic valve.

9 Claims, 2 Drawing Sheets

OIL LUBRICATION RATE MONITOR AND CONTROLLER

FIELD OF THE INVENTION

The present invention relates to lubrication systems of the gravity feed type.

BACKGROUND OF THE INVENTION

A primary objective of lubrication systems is to supply a constant rate of lubricant, such as oil, to a mechanical system. Among lubrication systems currently in use are 'active' and 'passive' systems. Active systems typically employ pumping devices that control the volume of oil being pumped, such as volumetric and peristaltic pumps. These systems are expensive and unwieldy. Passive systems are based on gravitational drip of the oil and typically consist of a container for the oil, a needle valve to control the flow thereof, and a nozzle and conduits for administration thereof. These systems are much simpler and less expensive than the active systems, but have the disadvantage in that they have no way to maintain a constant oil drip rate. The oil drip rate in such systems varies significantly with variations in the viscosity of the oil, which may result from changes in temperature such as occur between day and night, and with variation in the height of the oil in a container or its static pressure head, as the supply is depleted. The nozzle and conduits are also subject to blockages, partial and full, caused by particulate impurities in the lubricant.

U.S. Pat. No. 4,428,442 discloses a lubricating system for normally air-lubricated mining bits in which oil is forced under pressure into the relevant passages. This system is not concerned with gravitational flow of lubricant or with the solving the problem of maintaining a constant rate of lubrication.

U.S. Pat. No. 5,598,973 discloses a flow control mechanism in liquid dispensing guns in which a threaded shaft may be rotated in opposing rotational directions by electrically powered drive means in order to operate a valve between a full flow position and a number of reduced flow positions. Although the system may be operated to counter viscosity changes and blockages, there is no suggestion to adapt the system to controlling the drip rate of a gravitational flow lubrication system.

There are a number of patents dealing with the control of the rate of administration of a liquid medicament to a patient via gravitational drip systems, such as in intravenous infusion systems. U.S. Pat. Nos. 3,790,042 and 4,038,982 disclose systems in which the drip rate in a fluid drip chamber is measured and a valve or clamp controlling the rate of fluid administered is automatically opened or closed to maintain a desired drip rate. In their details, these systems are specific to medical applications and do not deal with problems inherent in lubrication of mechanical systems.

SUMMARY OF THE INVENTION

The present invention seeks to overcome disadvantages of existing actively pumped lubrication systems and limitations of passive gravitational drip lubrication systems, by providing a passive gravitational drip lubrication system which includes lubrication rate monitoring and control to provide a constant lubrication rate even in the presence of factors that might otherwise change the lubricant drip rate. The present invention is adaptable to existing passive gravitational drip lubrication systems and is simpler and less expensive than existing actively pumped lubrication systems.

There is thus provided, in accordance with a preferred embodiment of the present invention, a gravitational drip lubrication system for a mechanical system which includes:

- a reservoir of liquid lubricant of varying viscosity,
- an electromagnetically driven needle valve or other device and associated conduits for supplying the lubricant at a desired flow rate from the reservoir to the mechanical system,
- a drop detector and electronic counter or similar device for measuring the flow rate of the lubricant, and
- an electronic servo control unit for adjusting the valve based on the measured flow rate of the lubricant so as to maintain the desired lubricant flow rate substantially independently of factors affecting the flow such as the viscosity of the lubricant, the static pressure head of the lubricant in the reservoir, and the presence of particulate impurities in the lubricant.

Additionally in accordance with a preferred embodiment of the present invention, for lubricants of temperature dependent viscosity, the lubrication system also includes a temperature compensation unit for heating the lubricant when its temperature gets so low that its viscosity is too great to maintain the desired lubricant flow rate by adjusting the electromagnetic valve alone.

Further in accordance with a preferred embodiment of the present invention, the electronic servo control unit can switch among different operational states associated with different desired lubricant flow rates including:

- a working state associated with a lubrication rate required for normal operation of the mechanical system;
- a standby state associated with the minimum required lubrication rate required to maintain the mechanical system when it is idle, and
- a no-flow state wherein, in response to a very large or a large and sudden reduction in the measured flow rate of the lubricant, the electronic servo control unit starts opening the valve towards a predetermined maximum position and then, if a predetermined time has elapsed and the measured lubricant flow rate has not returned to normal, the electronic servo control unit starts closing the valve towards its fully closed position.

Additionally in accordance with a preferred embodiment of the present invention, the electronic servo control unit also includes an interface to control the operation of the mechanical system and an alarm circuit to issue an alarm signal in response to predetermined exceptional states of the lubrication system. If a predetermined time has elapsed after the servo control unit has switched to the no-flow state and the measured lubricant flow rate has not returned to normal, the servo control unit activates the interface to shut down the mechanical system and issues an alarm signal.

BRIEF DESCRIPTION OF THE DRAWINGS

The present invention will be more fully understood and appreciated from the following detailed description, in which.

DETAILED DESCRIPTION OF THE INVENTION

Figure 1:
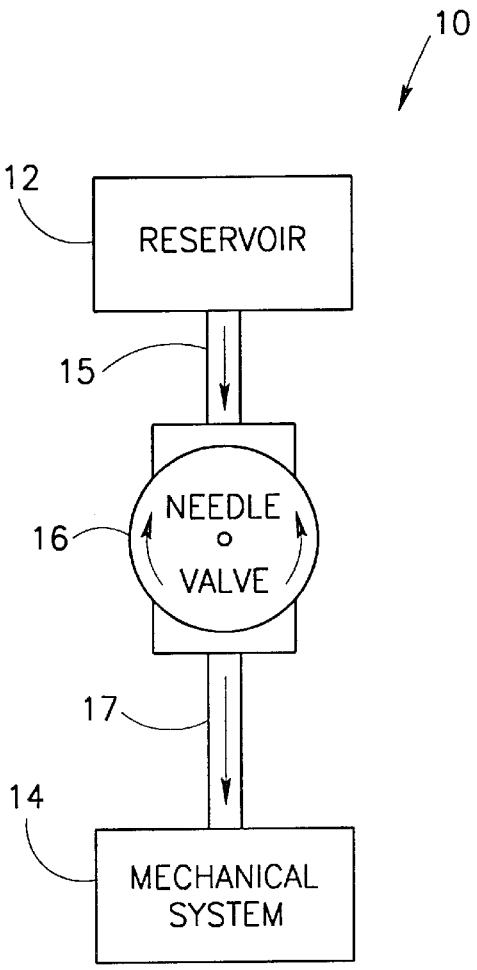
FIG.1 PRIOR ART
FIG. 1 is high-level schematic block diagram of a PRIOR ART passive lubrication system.

Referring now to FIG. 1, there is shown, a high-level schematic block diagram of a PRIOR ART passive lubrication system. A passive gravitational drip lubrication system, referred to generally as 10, includes a lubricant reservoir 12 which is linked to a mechanical system 14 requiring lubrication via a needle valve 16 having an inlet 15 and an outlet 17. Needle valve 16 can provide fine control of the lubricant flow through lubrication system 10, but there is no way to compensate for changes in the lubricant flow rate except by manual adjustment. Problems inherent in this type of system are discussed in the Background of the Invention and thus, are not described again herein.

Figure 2:
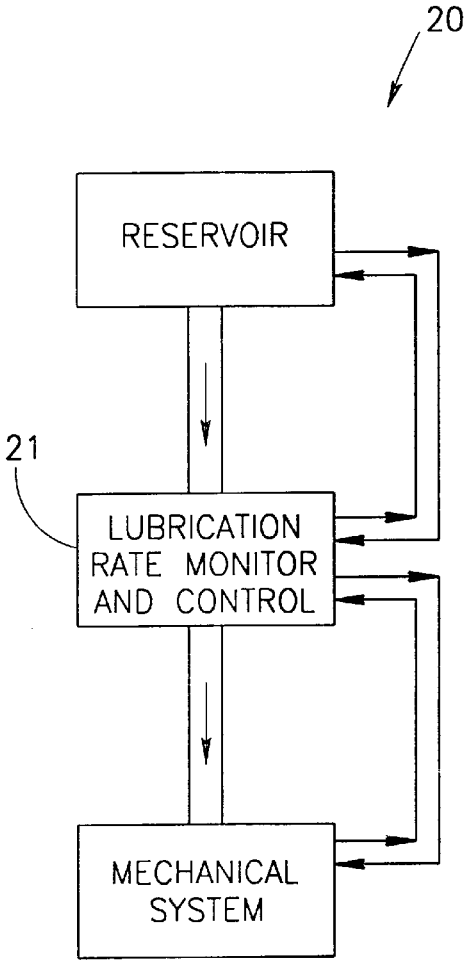
FIG. 2 is high-level schematic block diagram of a lubrication system constructed and operative in accordance with a preferred embodiment of the present invention.

Referring now to FIG. 2, there is shown, a high-level schematic block diagram of a gravitational drip lubrication system, constructed and operative in accordance with a preferred embodiment of the present invention. The gravitational drip lubrication system, referred to generally as 20, has a lubrication rate monitor and control system 21 in place of needle valve 16 of the PRIOR ART passive lubrication system 10 shown in FIG. 1. Unlike the PRIOR ART system, the present system is capable of compensating for changes in the lubricant flow rate, as described below.

Figure 3:
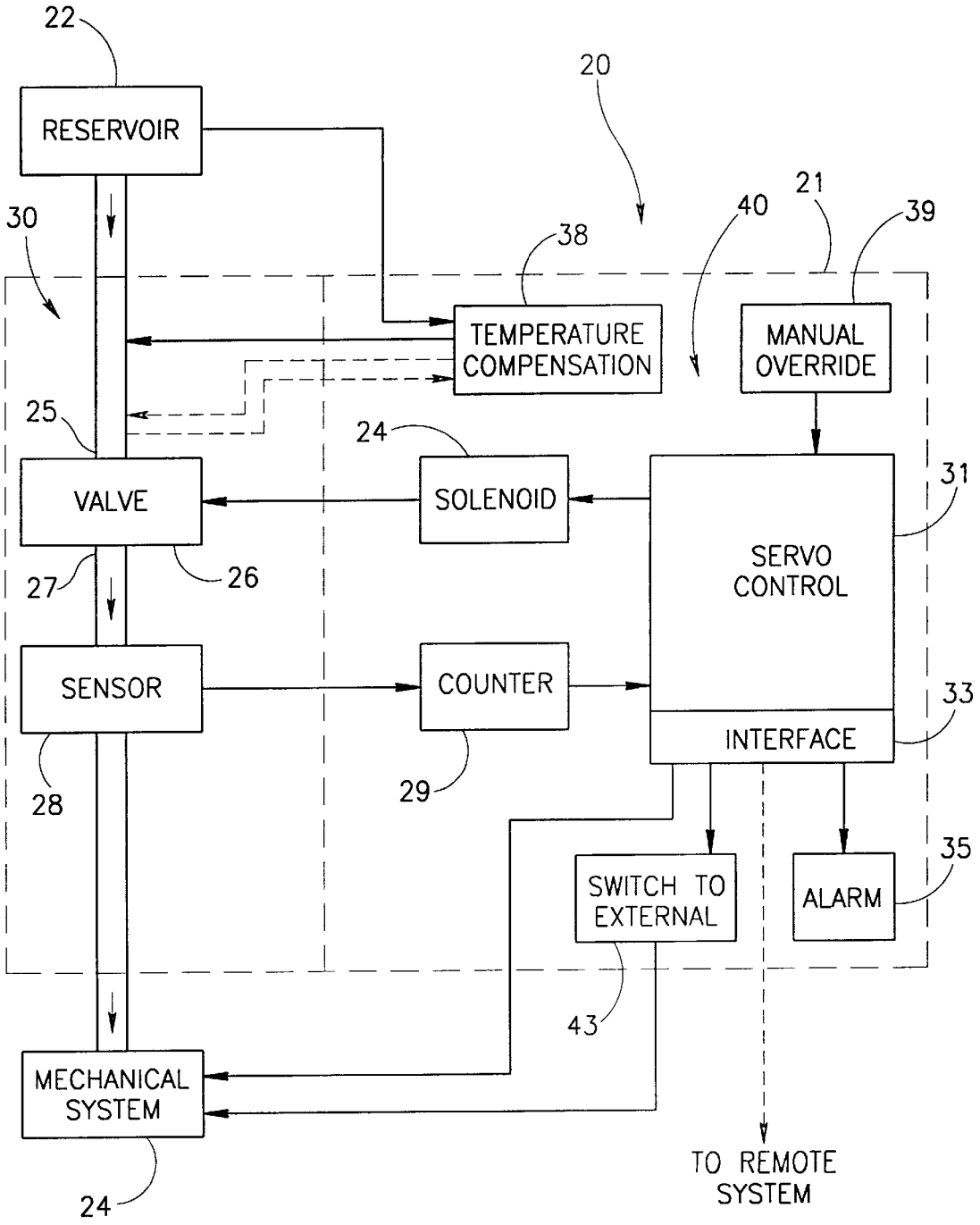
FIG. 3 is a more schematic block diagram of the lubrication system of FIG. 2.

Referring now to FIG. 3, it is seen that lubrication rate monitor and control system 21 includes a lubricant supply line, referred to generally as 30, and a monitor and control subsystem, referred to generally as 40.

Lubricant supply line 30 extends from a reservoir 22, seen also in FIG. 2, followed by needle valve 26, which has a valve inlet 25 and a valve outlet 27. Valve outlet 27 has associated therewith a drop sensor 28, which typically comprises an inline drip detection chamber with an optical drop detector. Drop sensor 28 alternatively can be any other suitable detector, such as a piezoelectric drop detector and may not necessarily include an inline detection chamber. From sensor 28 the lubricant is delivered to the mechanical system 24 to be lubricated.

The primary component of monitor and control subsystem 40 is servo control unit 31 which manages the monitoring and control functions of the system. These functions and components needed to perform them are described below.

In a simple alternative embodiment of the present invention, valve 26 is driven by a solenoid 24 or any other suitable electromagnetic driver device known in the art. Sensor 28 together with an associated counter circuit 29 measures the number of drops emitted by valve 26 in a period of time, for example, per minute, and provides output signals which are indicative of the lubricant flow rate. Counter circuit 29 sends the measured lubricant flow rate to servo control unit 31 which compares it to a desired flow rate as by suitable comparator circuitry (not shown). If the measured flow rate deviates from the desired rate by more than a predetermined amount, servo control unit 31 signals solenoid 24 to open or close valve 26 by a predetermined increment to increase or decrease the lubricant flow as may be required, thereby returning the lubricant flow rate to the desired value. A typical cause of variation in the lubricant flow rate is a change in the viscosity of the lubricant, such as is known to occur with variation in the temperature of the lubricant, such as between night and day or with variation in the season. For example, applications wherein a lubricant must be of food grade, such as drilling for drinking water, employ as lubricants paraffin oils which are known to have a viscosity that is highly dependent on temperature. Another known cause of variation in the lubricant flow rate is depletion of the supply of lubricant in reservoir 22, which causes a reduction in the static pressure head thereof.

It should be noted that devices such as servo control unit 31, counter circuit 29, drop sensor 28, and valve 26 and solenoid 24 combinations are known in the art and are readily available and are therefore not described in detail herein. Further, algorithms controlling the timing of the flow rate measurements and the incremental opening and closing of valve 26 so to provide a stable convergence of the flow rate to the desired value are also known in the art and are included in known servo control units.

The present invention is also capable of dealing with a case of very low environmental temperature, wherein the viscosity of the lubricant becomes so great that a desired lubrication rate cannot be maintained even when valve 26 is fully open. In accordance with a preferred embodiment of the present invention, lubrication system 20 thus further includes a temperature compensation unit 38, which, in response to a measured lubricant temperature in reservoir 22 below a predetermined value, selectively heats the lubricant upstream of valve inlet 25. This lowers the lubricant viscosity, thereby allowing the desired flow rate to be maintained by normal operation of valve 26. In alternative embodiments, the aforementioned temperature measurement and heating controlled by temperature compensation unit 38 may optionally be at any suitable locations in the lubricant supply line upstream of valve 26. This is indicated schematically in FIG. 3 by the additional broken lines extending from temperature compensation unit 38 to valve inlet 25, by way of example.

In accordance with a further preferred embodiment of the present invention, servo control unit 31 further includes a plurality of operative states corresponding to a plurality of predetermined ranges of lubricant flow rates, and provision for switching therebetween. For example, these can include a 'working' state for lubrication of the mechanical system 24 during normal operation and a 'standby' state during which at least a minimal lubrication is provided, when mechanical system 24 is idle. In this embodiment, lubrication system 20 also includes a manual override 39 for manually selecting a particular predetermined operative state.

A further cause of reduction in the lubricant flow rate is blockage of lubricant flow due to the presence of particulate impurities in the lubricant, such as is common in the aforementioned drilling application. In a further preferred embodiment of the present invention, servo control unit 31 additionally has a 'no-flow' state which is initiated when there is a large and possibly sudden reduction in the measured lubricant flow rate, such as can occur as a result of the presence of particulate impurities in the lubricant. Further, when the supply of lubricant in reservoir 22 is totally depleted, the measured lubricant flow rate will drop to zero. Another possibility whereby the lubricant flow rate is interpreted by the system to be zero is when the lubricant flow rate is so great that the flow is a continuous stream without discrete drops.

When such drastic reductions in the measured flow rate occur, servo control unit 31 switches to the no-flow state and signals solenoid 24 to drive valve 26 towards its fully open position in an attempt to flush out impurities and the resultant blockage. If the measured flow rate does not return to its normal value within a predetermined time interval, servo control unit 31 then signals solenoid 24 to drive valve 26 towards its fully closed position in an attempt to achieve a measurable drip rate for the abovementioned case of continuous, dripless flow. If valve 26 reaches its fully closed position without the measured flow rate returning to its normal value, servo control unit 31 employs a suitable interface circuit 33 to shut down mechanical system 24, activates alarm 35, and switches to its standby state.

A further feature of lubrication system 20 of the present embodiment is an additional function of manual override 39 to turn servo control unit 31 on and off and to switch the mechanical system 24 to external control 43 when servo control unit 31 is switched off. Servo control unit 31 optionally can further be configured to relay the lubricant flow rate signal produced by counter circuit 29 to a remote system.

It will be appreciated by persons skilled in the art that the present invention is not limited by what has been shown and described hereinabove, merely by way of illustrative example. Rather, the scope of the present invention is limited solely by the claims, which follow:

I claim:

1. A gravitational drip lubrication system for a mechanical system, which includes:

a reservoir of liquid lubricant of varying viscosity, apparatus for supplying the lubricant at a preselected flow rate from said reservoir to a mechanical system, having an inlet associated with said reservoir and an outlet adjacent to the mechanical system and including electromagnetic valve apparatus for adjusting the flow rate of the lubricant, flow measurement apparatus for measuring the flow rate of the lubricant, and servo control apparatus for adjusting said electromagnetic valve apparatus in accordance with the flow rate of the lubricant measured by said flow measurement apparatus so as to maintain the preselected lubricant flow rate substantially independently of dynamic flow parameters of the lubricant wherein said servo control apparatus includes switching apparatus for selecting one of a plurality of operational states wherein each of said plurality of operational states has associated therewith one of a plurality of predetermined lubricant flow rates; and wherein said servo control apparatus further includes:

interface apparatus associated with switching apparatus for controlling operation of the mehanical system, and alarm apparatus for issuing an alarm signal in response to predetermined exceptional states of said lubrication system; and wherein said plurality of predetermined operational states includes:

a working state associated with a lubrication rate required for normal operation of the mechanical system;

a standby state associated with the minimum required lubrication rate required to maintain the mechanical system when it is idle; and a no-flow state wherein, in the presence of a reduction in the measured flow rate of the lubricant of greater than a predetermined value, said servo control apparatus is operative to provide to said electromagnetic valve apparatus a predetermined signal so as to cause it to open towards a predetermined maximum position.

2. A gravitational drip lubrication system according to claim 1 wherein said flow measurement apparatus includes:

drop detector apparatus arranged in association with said outlet for sensing drops exiting therefrom, and electronic counter apparatus for determining the number of drops detected by said drop detector apparatus in a predetermined period of time.

3. A gravitational drip lubrication system according to claim 1 wherein said electromagnetic valve apparatus includes a needle valve and electromagnetic apparatus for opening and closing said needle valve.

4. A gravitational drip lubrication system according to claim 1 wherein said dynamic flow parameters include at least one of the viscosity of the lubricant, the static pressure head of the lubricant in said reservoir, and the presence of particulate impurities in the lubricant.

5. A gravitational drip lubrication system according to claim 1 wherein the lubricant is a substance of temperature dependent viscosity and wherein said system further includes temperature compensation apparatus for selectively heating the lubricant in the presence of a lubricant temperature below a predetermined value whereat the viscosity of the lubricant is too great to maintain the preselected lubricant flow rate by adjusting said electromagnetic valve apparatus.

6. A gravitational drip lubrication system according to claim 1 wherein, in the presence of a reduction in the measured flow rate of the lubricant of greater than a predetermined value, said servo control apparatus is operative to provide to said electromagnetic valve apparatus a predetermined signal so as to cause it to open towards a predetermined maximum position.

7. A gravitational drip lubrication system according to claim 6 wherein, in the presence of a reduction in the measured flow rate of the lubricant of greater than a predetermined value occurring in less than a predetermined time, said servo control apparatus is operative to provide to said electromagnetic valve apparatus a predetermined signal so as to cause it to open towards a predetermined maximum position.

8. A gravitational drip lubrication system for a mechanical system, which includes:

a reservoir of liquid lubricant of varying viscosity, apparatus for supplying the lubricant at a preselected flow rate from said reservoir to the mechanical system, having an inlet associated with said reservoir and an outlet adjacent to the mechanical system and including electromagnetic valve apparatus for adjusting the flow rate of the lubricant, flow measurement apparatus for measuring the flow rate of the lubricant, and servo control apparatus for adjusting said electromagnetic valve apparatus in accordance with the flow rate of the lubricant measured by said flow measurement apparatus so as to maintain the preselected lubricant flow rate substantially independently of dynamic flow parameters of the lubricant, wherein said servo control apparatus includes switching apparatus for selecting one of a plurality of operational states and wherein each of said plurality of operational states has associated therewith one of a plurality of predetermined lubricant flow rates; and wherein said servo control apparatus further includes:

interface apparatus associated with switching apparatus for controlling operation of the mehanical system, and alarm apparatus for issuing an alarm signal in response to predetermined exceptional states of said lubrication system; and wherein said plurality of predetermined operational states includes:

a working state associated with a lubrication rate required for normal operation of the mechanical system;

a standby state associated with the minimum required lubrication rate required to maintain the mechanical system when it is idle; and a no-flow state wherein, in the presence of a reduction in the measured flow rate of the lubricant of greater than a predetermined value, said servo control apparatus is operative to provide to said electromagnetic valve apparatus a predetermined signal so as to cause it to open towards a predetermined maximum position; and wherein after a predetermined time has elapsed after said servo control apparatus has switched to said no-flow state, if the measured lubricant flow rate has not returned to the flow rate associated with said normal state, said servo control apparatus is operative to provide said electromagnetic valve apparatus a predetermined signal so as to cause it to close towards a fully closed position, and wherein if said electromagnetic valve apparatus has reached its fully closed position and the measured lubricant flow rate has not returned to the flow rate associated with said normal state, said servo control apparatus is operative to activate said interface apparatus so as to stop the operation of the mechanical system, to activate said alarm apparatus, and to switch to said standby state.

9. A gravitational drip lubrication system for a mechanical system, which includes:

a reservoir of liquid lubricant of varying viscosity, apparatus for supplying the lubricant at a preselected flow rate from said reservoir to the mechanical system, having an inlet associated with said reservoir and an outlet adjacent to the mechanical system and including electromagnetic valve apparatus for adjusting the flow rate of the lubricant, flow measurement apparatus for measuring the flow rate of the lubricant, and servo control apparatus for adjusting said electromagnetic valve apparatus in accordance with the flow rate of the lubricant measured by said flow measurement apparatus so as to maintain the preselected lubricant flow rate substantially independently of dynamic flow parameters of the lubricant, wherein said servo control apparatus includes switching apparatus for selecting one of a plurality of operational states and wherein each of said plurality of operational states has associated therewith one of a plurality of predetermined lubricant flow rates; and wherein said servo control apparatus further includes:

interface apparatus associated with switching apparatus for controlling operation of the mehanical system, and alarm apparatus for issuing an alarm signal in response to predetermined exceptional states of said lubrication system; and wherein said plurality of predetermined operational states includes:

a working state associated with a lubrication rate required for normal operation of the mechanical system;

a standby state associated with the minimum required lubrication rate required to maintain the mechanical system when it is idle; and a no-flow state wherein, in the presence of a reduction in the measured flow rate of the lubricant of greater than a predetermined value, said servo control apparatus is operative to provide to said electromagnetic valve apparatus a predetermined signal so as to cause it to open towards a predetermined maximum position; and wherein said servo control apparatus switches to said no-flow state in response to a reduction in the measured flow rate of the lubricant of greater than a predetermined value occurring in less than a predetermined time.

* * * * *